US008659184B2

(12) United States Patent
Conrad

(10) Patent No.: US 8,659,184 B2
(45) Date of Patent: Feb. 25, 2014

(54) METHOD AND APPARATUS FOR POWERING AN APPLIANCE

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 440 days.

(21) Appl. No.: 13/041,103

(22) Filed: Mar. 4, 2011

(65) Prior Publication Data

US 2012/0223581 A1 Sep. 6, 2012

(51) Int. Cl.
*H02J 1/10* (2006.01)

(52) U.S. Cl.
USPC ..... 307/43

(58) Field of Classification Search
USPC ..... 307/43
See application file for complete search history.

(56) References Cited

U.S. PATENT DOCUMENTS

| | | | | |
|---|---|---|---|---|
| 5,268,845 | A | 12/1993 | Startup et al. | |
| 5,402,059 | A | 3/1995 | Bittar | |
| 5,694,029 | A | 12/1997 | Hayes et al. | |
| 5,742,153 | A | 4/1998 | McEachern et al. | |
| 5,798,633 | A | 8/1998 | Larsen et al. | |
| 5,831,420 | A | 11/1998 | Myers | |
| 6,031,357 | A | 2/2000 | Yano et al. | |
| 6,081,104 | A | 6/2000 | Kern | |
| 6,307,358 | B1 | 10/2001 | Conrad | |
| 6,327,162 | B1 * | 12/2001 | Larsen et al. | 363/51 |
| 6,891,355 | B2 | 5/2005 | Kernahan | |
| 6,909,266 | B2 | 6/2005 | Kernahan et al. | |
| 2001/0048295 | A1 | 12/2001 | Joch | |
| 2003/0173940 | A1 | 9/2003 | Kovarik et al. | |
| 2004/0051510 | A1 | 3/2004 | Saggini et al. | |
| 2004/0095118 | A1 | 5/2004 | Kernahan | |
| 2007/0200540 | A1 | 8/2007 | Hashimoto et al. | |
| 2008/0191675 | A1 | 8/2008 | Besser et al. | |
| 2009/0295330 | A1 * | 12/2009 | Li et al. | 320/124 |

FOREIGN PATENT DOCUMENTS

| | | |
|---|---|---|
| WO | 9522190 | 8/1995 |
| WO | 03034566 | 4/2003 |

* cited by examiner

*Primary Examiner* — Robert L. Deberadinis
(74) *Attorney, Agent, or Firm* — Philip C. Mendes da Costa; Bereskin & Parr LLP/S.E.N.C.R.L., s.r.l.

(57) ABSTRACT

A battery operated vacuum cleaner is provided with one or more principal batteries and one or more supplemental batteries. The batteries and a controller are configured such that as the power provided by the principal batteries drops, one or more of the supplemental batteries is operative connected to provide power to the appliance. A method for providing a substantially constant level of power to an appliance, such as a vacuum cleaner, using a plurality of power sources comprises providing power from a principal power source connected to the appliance; monitoring an operating voltage supplied to the appliance to detect if the operating voltage is below a predetermined threshold voltage level; and upon detecting that the operating voltage is below the predetermined threshold voltage level, providing power from k of n supplemental power sources connected to the appliance, where k and n are positive integers, and k is less than or equal to n. Optionally, upon detecting that the operating voltage is below the predetermined threshold voltage level and where k is equal to n, the principal and supplemental power sources are disengaged from the appliance.

21 Claims, 5 Drawing Sheets

METHOD AND APPARATUS FOR POWERING AN APPLIANCE

FIELD

The described embodiments relate generally to an appliance, such as a surface cleaning apparatus (e.g., a vacuum cleaner) or a power tool (e.g., a drill) which have an onboard power source (e.g., a plurality of batteries) or which are connected to same, wherein a substantially constant level of power is provided to the appliance. The described embodiments also relate to methods of operating same.

INTRODUCTION

Batteries or cells (hereinafter batteries) may provide power to mechanical or electrical systems. Batteries are commonly classified into two types, namely: primary cells, which are single use cells and, after discharge, cannot be recharged for further use; and secondary cells or batteries, which are subjected to a large number of charge and discharge cycles.

Primary cells (such as alkaline or zinc-air batteries) are often used to power smaller, less frequently used low-voltage electrical loads (e.g. television remote controls, hearing aids). Larger or more frequently used loads (e.g. cordless appliances, laptop computers) are typically powered with secondary cells. Known secondary cell types include nickel cadmium (NiCd), nickel metal hydride (NiMH), lithium ion (Li-ion)), and lithium polymer batteries (Li-poly), for example.

Powering electrical loads with batteries can provide advantages, such as cordless operation and portability, for example. However, the voltage supplied by the batteries decreases as the batteries are discharged. While the drop in voltage may be tolerable for certain electrical loads, the drop in voltage may be problematic in other applications where the load requires a minimum or uniform voltage level to operate effectively.

The performance of a battery-powered system may be proportional to the power or voltage provided by the batteries. For example, the torque provided by a battery-powered drill may decrease as the voltage provided by its batteries decreases. Similarly, the suction provided by a battery-powered vacuum cleaner may decrease as the voltage provided by its batteries decreases.

This variability in performance may be undesirable, as the system may appear to be performing poorly when the batteries are supplying a reduced voltage.

To provide more consistent performance of the system, one option would be to have the system shut off if the voltage provided by the power source falls below a certain threshold level. However, given the typical discharge profile of secondary cells (e.g. NiMH, NiCd, Li-ion), this may result in a system with a relatively short operational cycle.

In addition, even if the appliance is operating with design specifications at the reduced voltage, the sound produced by the operation of the drill or the vacuum cleaner may be reduced. This may cause a consumer to turn the appliance off and recharge or replace the batteries even when the appliance is still operating within the design specifications.

SUMMARY

In accordance with an aspect of the embodiments described herein, an appliance is configured to initially operate using one or more principal independent power sources and to operate using one or more supplemental independent power sources as the power provided by the principal independent power sources drops (e.g., the output voltage of the principal independent power sources drops).

An advantage of this design is that the operation of the appliance will appear generally constant to a user. In accordance with this aspect, the appliance is designed to operate on a reduced number of batteries than are provided onboard an appliance. For example, the appliance may house 10 batteries. The appliance may be designed to initially operate using 8 batteries. When the power provided by the 8 batteries drops below a particular level, then one of the other two batteries may be used to continue to power the operation of the appliance. When the power provided by the 9 batteries drops below a particular level, which may be the same particular level, then the final battery may be used to continue to power the operation of the appliance. Accordingly, the appliance will continue to operate for the full life of the 10 batteries.

It will be appreciated that the appliance could be designed to operate using all 10 batteries at all times during operation of the appliance. As the power provided by the batteries is reduced, the sound produced by the motor of the appliance may be reduced. In such a case, the user may become concerned that the appliance needs recharging and may shut the appliance off prematurely thereby not using the full operation life of the appliance.

Further, an appliance may be designed to work in an optimal range based on the power supplied to the appliance. For example, the cleaning performance of a vacuum cleaner is based, in part, on the velocity of air at the dirty air inlet of the cleaning head. As the velocity is reduced, then the cleaning performance of the vacuum cleaner drops. Therefore, by systematically using power from additional batteries to provide additional power to a suction motor, a vacuum cleaner may be designed to operate for an extended period of time at about a constant power level and therefore, to provide about a constant cleaning performance.

An independent power source is a power source that does not draw power from an electrical grid, e.g., the electrical outlet in a house, to power the appliance during use of the appliance. A battery or a battery pack is an exemplary independent power source.

The independent power source is preferably provided on board the appliance (e.g., a battery pack may be received in or on a housing of the appliance). If the appliance is used at times in a stationary environment, (e.g., a power tool) then the battery pack may be provided in a separate housing and connected to the appliance by, e.g., an electrical cable.

In accordance with one aspect of the embodiments described herein, an appliance comprises an onboard principal power source; at least one supplemental onboard power sources; and, a microcontroller configured to monitor an operating voltage being provided to the appliance, and further configured to provide power from one or more of the supplemental onboard power sources when the operating voltage is determined to be below a predetermined threshold voltage level.

In one embodiment, the appliance comprises n supplemental power sources, where n is a positive integer and the microcontroller is configured to provide power from k of n supplemental power sources, where k is a positive integer less than or equal to n, when the operating voltage is determined to be below the predetermined threshold voltage level.

In another embodiment, the primary power source and the n supplemental power sources are connected in series with respect to the load. In another embodiment, n is equal to two.

In another embodiment, the principal power source is rated to provide a principal voltage and each of the n supplemental power sources are rated to provide a supplemental voltage, and wherein the principal voltage is between 0% and 30% greater than the predetermined threshold voltage level and wherein the supplemental voltage is between 5% and 25% of the predetermined threshold voltage level. Preferably, the principal voltage is between 5% and 8% greater than the predetermined threshold voltage level and the supplemental voltage is between 12% and 15% of the predetermined threshold voltage level.

In another embodiment, the principal voltage is between 0 and 3 volts greater than the predetermined threshold voltage level and wherein the supplemental voltage is between 0 and 3 volts. Preferably, the primary voltage is 9.6 volts and the supplementary voltage is 1.2 volts.

In another embodiment, the apparatus further comprises a voltmeter operatively coupled to the load and the microcontroller for measuring the operating voltage In another embodiment, the principal power source comprises one or more batteries and the supplemental power source comprises one or more batteries. Preferably, the supplemental power source comprises a plurality of batteries. Alternately, or in addition, the principal power source comprises a plurality of batteries.

In accordance with another aspect of embodiments described here, a method for providing a substantially constant level of power to an appliance comprises providing power to the appliance from a principal power source connected to the appliance; monitoring an operating voltage supplied to the appliance to detect if the operating voltage is below a predetermined threshold voltage level; and, upon detecting that the operating voltage is below the predetermined threshold voltage level, providing power to the appliance from at least one supplemental power source connected to the appliance.

In one embodiment, the method comprises providing power from k of n supplemental power sources connected to the appliance, where k and n are positive integers, and k is less than or equal to n.

In another embodiment, the method further comprises, upon detecting that the operating voltage is below the predetermined threshold voltage level and where k is equal to n, disengaging the principal and supplemental power sources from the load.

In another embodiment, power is provided from each of the k supplemental power sources to the load in sequence, and the operating voltage is measured after each of the k supplemental power sources are added.

In one embodiment, n is equal to two.

In another embodiment, the principal power source is rated to provide a principal voltage and each of the n supplemental power sources are rated to provide a supplemental voltage, and the principal voltage is between 0% and 30% greater than the predetermined threshold voltage level and the supplemental voltage is between 5% and 25% of the predetermined threshold voltage level. Preferably, the principal voltage is between 5% and 8% greater than the predetermined threshold voltage level and the supplemental voltage is between 12% and 15% of the predetermined threshold voltage level.

In another embodiment, the principal voltage is between 0 and 3 volts greater than the predetermined threshold voltage level and wherein the supplemental voltage is between 0 and 3 volts. Preferably, the primary voltage is 9.6 volts and the supplementary voltage is 1.2 volts.

BRIEF DESCRIPTION OF THE DRAWINGS

For a better understanding of embodiments of the methods and apparatus 300 described herein, and to show more clearly how they may be carried into effect, reference will be made, by way of example, to the accompanying drawings in which.

Figure 1A:
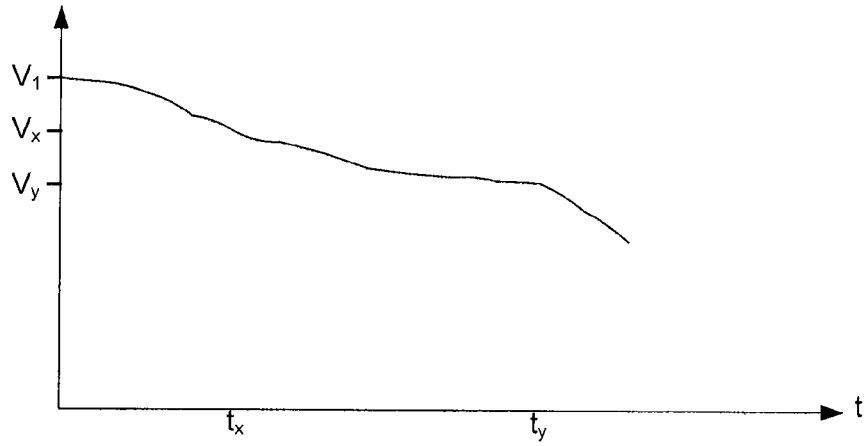
FIG. 1A illustrates an exemplary voltage discharge profile of a battery.

The drawings, described below, are provided for purposes of illustration, and not of limitation, of the aspects and features of various examples of embodiments described herein. The drawings are not intended to limit the scope of the applicants' teachings in any way. For simplicity and clarity of illustration, elements shown in the figures have not necessarily been drawn to scale. The dimensions of some of the elements may be exaggerated relative to other elements for clarity. Further, where considered appropriate, reference numerals may be repeated among the figures to indicate corresponding or analogous elements.

DESCRIPTION OF EXEMPLARY EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing implementation of the various embodiments described herein.

Referring now to FIG. 1A, which illustrates an exemplary voltage discharge profile of a battery. FIG. 1A illustrates an example battery with rated voltage $V_1$ that can provide $V_x$ volts at time $t_x$, and $V_y$ volts at time $t_y$. As shown in FIG. 1A, the voltage provided by the battery decreases over time as the battery discharges. While the discharge profile of a battery may be relatively flat, there can be a significant variation in the voltage level provided by the battery over time as it supplies power to a load. The decreasing voltage level of a battery over time can impose a trade-off between the power level and the duration of time the load can operate.

For applications where the performance of a load is proportional to the supplied voltage level, the decreasing voltage level of a battery may result in a trade-off between average performance and operating time. That is, the load may exhibit a relatively higher average performance up to time $t_x$ (while the supplied voltage is between $V_1$ and $V_x$), a relatively average performance between time $t_x$ and time $t_y$ (while the supplied voltage is between $V_x$ and $V_y$), and a relatively lower average performance after time $t_y$ (e.g. while the supplied voltage is lower than $V_y$).

This may be viewed as a trade-off between variability of performance and operating time; the greater the operating time, the greater the performance will vary depending on where in the discharge cycle the cells are. The load may exhibit relatively high performance while the supplied voltage is between $V_1$ and $V_x$, but the load may exhibit relatively lower performance, and possibly unacceptable performance, while the supplied voltage is lower than $V_y$.

This variability may impact the performance of the load or system. For example, if the system is a surface cleaning apparatus, such as a vacuum cleaner, and the load is its suction motor, the suction motor's ability to provide an air inlet velocity at the dirty air inlet of the cleaning head may be proportional to the level of voltage provided to the suction motor by the battery. If the operating voltage provided to the suction motor is too low, the air inlet velocity may not be sufficient to properly clean the surface being cleaned. This may result in poor performance of the vacuum cleaner. The vacuum cleaner may work well when a high voltage is provided to its suction motor (e.g. when the battery is fully charged), but functions less effectively when a lower voltage is provided to the suction motor (e.g. when the battery is partially discharged). For example, referring back to FIG. 1A, the vacuum cleaner may have excellent air inlet velocity while the voltage supplied to the motor is between $V_1$ and $V_x$, but provide mediocre or poor air inlet velocity where the voltage supplied to the suction motor is between $V_x$ and $V_y$, and provide unacceptable air inlet velocity where the voltage supplied to the suction motor is less than $V_y$. A user who picks up a vacuum cleaner with a partially discharged battery may have a different perception of the cleaning performance of the vacuum cleaner based on where in the discharge cycle the battery is.

In order to maintain an adequate performance of the system, in accordance with embodiments described herein, it may be desirable to only allow the system to operate if at least a minimum voltage is being supplied to the load. Once the operating voltage being provided to the load falls below a predetermined threshold voltage level, the system would cease to operate until its power source has been recharged, or supplemented or replaced so as to provide at least the predetermined threshold voltage level. For example, if the system is a vacuum cleaner, a power control system may be designed such that the vacuum cleaner only operates while the voltage is above $V_x$ or $V_y$.

However, given a typical battery discharge profile, setting the predetermined threshold voltage level close to the rated voltage of the total power supply may result in a relatively short operational cycle. That is, the system may only be operable for a relatively short period of time, such as $t_x$ for example, before the predetermined threshold voltage level, such as $V_x$ for example, is reached and the system ceases operation.

In accordance with at least one embodiment described herein, it may be desirable to use a plurality of cells or batteries to provide a substantially constant level of power to a load and system. By providing a substantially constant operating voltage to the load (e.g. the motor of a vacuum cleaner) and system (e.g. the vacuum cleaner), the system may exhibit a substantially constant level of performance (e.g. air inlet velocity) throughout the operating cycle of the cells or batteries. This may result in a more consistent performance and quality of the system.

Figure 1B:
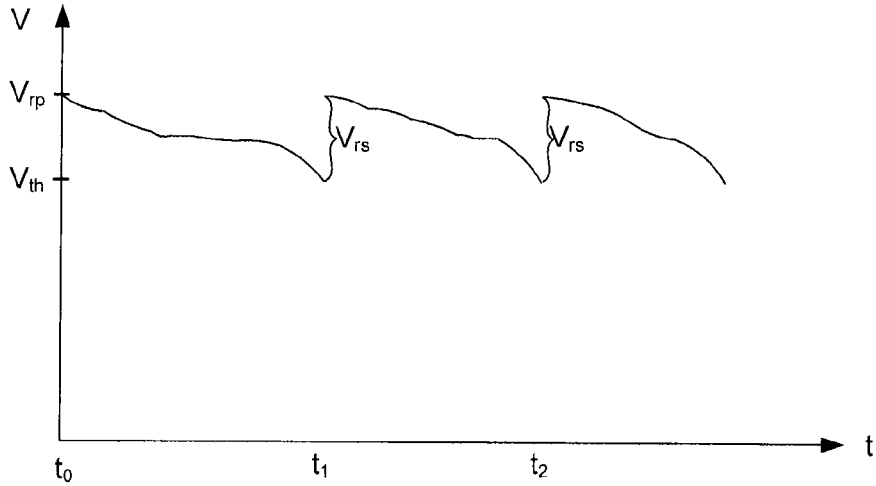
FIGS. 1B, 1C, 1D and 1E illustrate exemplary voltage discharge profiles of a method and apparatus in accordance with at least one embodiment.

Reference is now made to FIG. 1B, which illustrates an exemplary voltage discharge profile of a method and apparatus in accordance with at least one embodiment. In this example, a principal power source having a rated voltage $V_{rp}$ is initially connected to a load at time $t_0$. The apparatus is operable to monitor the operating voltage being supplied to the load. Once the operating voltage being supplied to the load by the principal power source falls below a predetermined threshold voltage level $V_{th}$, which in this example is at time $t_1$, the apparatus connects a supplemental power source, preferably in series, with respect to the load in addition to the principal power source. The supplement power source has a rated voltage the $V_{rs}$. The total voltage provided by a plurality of cells is additive when the cells are arranged in series with respect to the load. As shown in the FIG. 1B, at time $t_1$ the apparatus connects the supplemental power source to the load in addition to the principal power source. The operating voltage supplied to the load will be the sum of the voltage being supplied by the partially discharged principal power source $V_{rp}$ and the voltage being supplied by the fresh supplemental power source $V_{rs}$, in order to increase the operating voltage being supplied to the load above the threshold voltage level $V_{th}$.

The apparatus will continue to monitor the operating voltage provided by the principal power source and the supplemental power source(s) to the load. As the principal power source and the supplemental power source continue to discharge, the operating voltage being supplied to the load will fall until the apparatus once again detects that the operating voltage is below a predetermined threshold voltage, which may be the same predetermined threshold voltage level $V_{th}$, which is illustrated at time $t_2$ in FIG. 1B. When this occurs at time $t_2$, the apparatus connects an additional supplemental power source in series with respect to the load raising the operating voltage being supplied to the load by the voltage supplied by the additional supplemental power source $V_{rs}$. The operating voltage supplied to the load will be the sum of the voltage supplied by the partially discharged principal power source $V_{rp}$, the voltage supplied by the partially discharged supplemental power source $V_{rs}$, and the voltage supplied by the additional fresh supplemental power source $V_{rs}$ in order to increase the operating voltage being supplied to the load above the threshold voltage level $V_{th}$.

As shown in FIG. 1B, the peak operating voltage supplied to the load by the power sources ($V_{rp}$ or $V_{th}+V_{rs}$) is lower than the maximum operating voltage that could be supplied to the load if all of the power sources were initially engaged in series at the same time (i.e. $V_{rp}+V_{rs}+V_{rs}$). By sequentially connecting supplement power when the apparatus 300 detects that the operating voltage is below a threshold voltage level, a substantially constant level of power is provided to the load that ranges between $V_{th}$ and $V_{rp}$ (or in some embodiments $V_{th}+V_{rs}$). In certain embodiments, if $V_{rs}=V_{rp}-V_{th}$, then the power provided to the load will be between $V_{rp}$ and $V_{th}$.

In accordance with embodiments described herein, the supplemental power sources are connected sequentially in order to avoid large variations in the operating voltage.

Further, the rated voltages $V_{rs}$ for the supplemental power sources are preferably relatively small, and may be similar to the difference between the rated $V_{rp}$ of the principal power source and the threshold voltage value to avoid large variations. Further, if the operating voltage is much larger than the voltage required to operate the system then this may waste power. The rated voltage $V_{rs}$ for the supplemental power sources may be proportional to the threshold voltage value, and may range between 5 and 25% of the predetermined threshold value, for example. Further, the rated voltage $V_{rp}$ of the principal power source may be proportional to the threshold voltage value, and may range between 0 and 30% greater than the predetermined threshold value, for example.

FIG. 1B illustrates an exemplary embodiment and the apparatus may use other configurations to increase the operating voltage once it is detected to be below a threshold voltage level. For example, although the example shown in FIG. 1B involves a principal power source and two supplemental power sources, any number of supplemental power sources may be used. In addition, the supplemental power sources are illustrated as supplying the same amount of initial voltages $V_{rs}$ to the load but they need not be identical and may have differing amounts of initial voltages $V_{rs}$. Further, more than one supplementary power source may be connected at any one time. Although only one principal power source is shown there may be one or more principal power sources connected in parallel or series, as required by the load. As another example, FIG. 1B illustrates one predetermined threshold value $V_{th}$ but there may be different predetermined threshold value depending on the time.

Figure 1C:
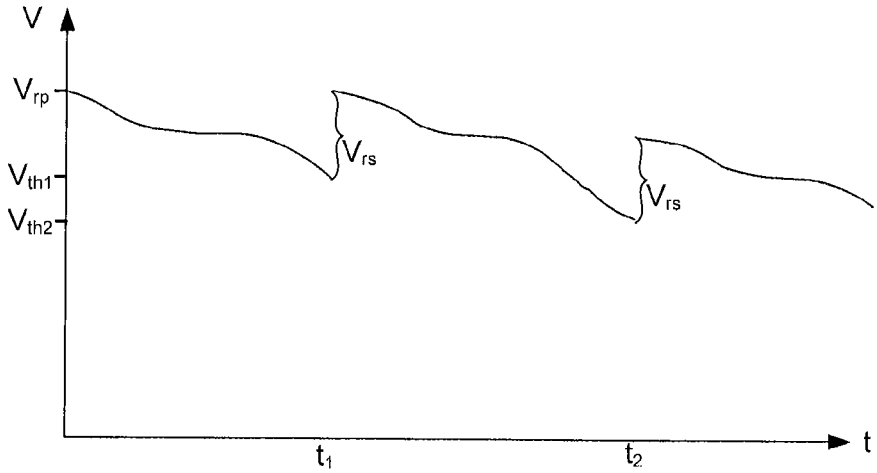

Reference is now made to FIG. 1C, which illustrates an exemplary voltage discharge profile of a method and apparatus in accordance with at least one other embodiment. FIG. 1C illustrates that more than one predetermined threshold voltage level can be used to determine when to engage additional supplemental power sources. In particular, a first threshold voltage level $V_{th1}$, and a second threshold voltage level $V_{th2}$ are used. The apparatus provides a substantially constant level of power to the load that ranges between $V_{th2}$ and $V_{rp}$ (or in some embodiments $V_{th1}+V_{rs}$ or $V_{th2}+V_{rs}$). To make the power level more consistent the difference between $V_{th2}$ and $V_{rp}$ is preferably relatively small but large enough to ensure adequate operation time.

Figure 1D:
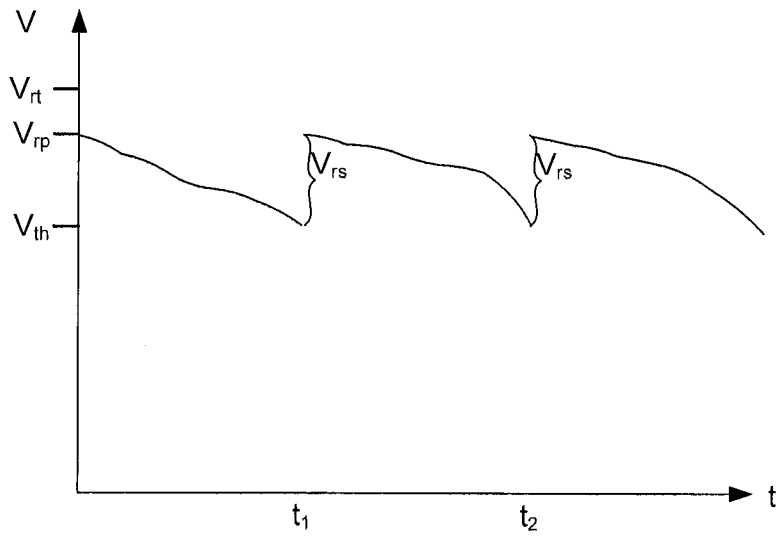

As a further example, FIG. 1B illustrates the addition of a supplemental power source with voltages $V_{rs}$ to increase the operating voltage up to the initial voltage $V_{rp}$ of the principal power source, at the time the apparatus detects the operating voltage to fall below the threshold voltage level $V_{th}$. The initial voltage of the supplemental power source can increase the operating voltage to a higher or lower value than the initial voltage $V_{rp}$ of the principal power source. Reference is now made to FIG. 1D, which illustrates an exemplary voltage discharge profile of a method and apparatus in accordance with at least one other embodiment. FIG. 1D illustrates that the addition of a supplemental power source with voltages $V_{rs}$ at the time the apparatus detects the operating voltage to fall below the threshold voltage level $V_{th}$ can increase the operating voltage to $V_{rt}$, which is more than the initial voltage $V_{rp}$ of the principal power source. The apparatus provides a substantially constant level of power to the load that ranges between $V_{th}$ and $V_{rt}$ (or in some embodiments $V_{rp}$)

Figure 1E:
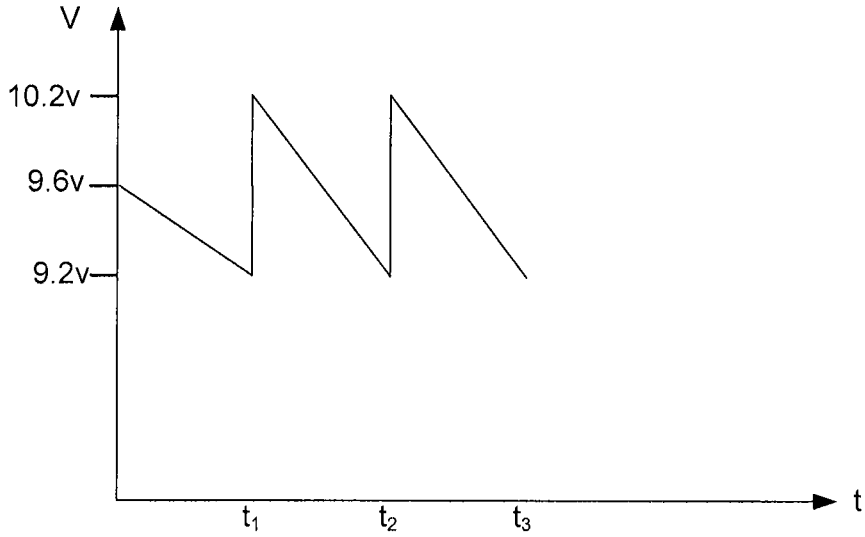

As an even further example, reference is now made to FIG. 1E, which illustrates an exemplary voltage discharge profile of a method and apparatus in accordance with at least one other embodiment. FIG. 1E illustrates that the principal power source has a rated voltage of 10.2V, each supplemental power source has a rated voltage of 1.2V and that the threshold voltage level is 9.2V. In this example, a principal power source having a rated voltage 9.6V is initially connected to a load at time $t_0$. At time $t_1$ the apparatus detects that the operating voltage is falling below the threshold voltage level of 9.2V and connects a supplemental power source with a rated voltage of 1.2V to the load to increase the operating voltage to 10.2V. At time $t_2$ the apparatus detects that the operating voltage is again falling below the threshold voltage level of 9.2V and connects an additional supplemental power source with a rated voltage of 1.2V to the load to increase the operating voltage to 10.2V. The apparatus is preferably operable to continue this process until no supplemental power sources are available to be connected to the load. At such time, the apparatus is preferably operable to stop the operation of the load and system, and optionally prompt for a battery recharge if applicable. In this example, the apparatus provides a substantially constant level of power to the load that ranges between 9.2V and 10.2V.

Figure 2:
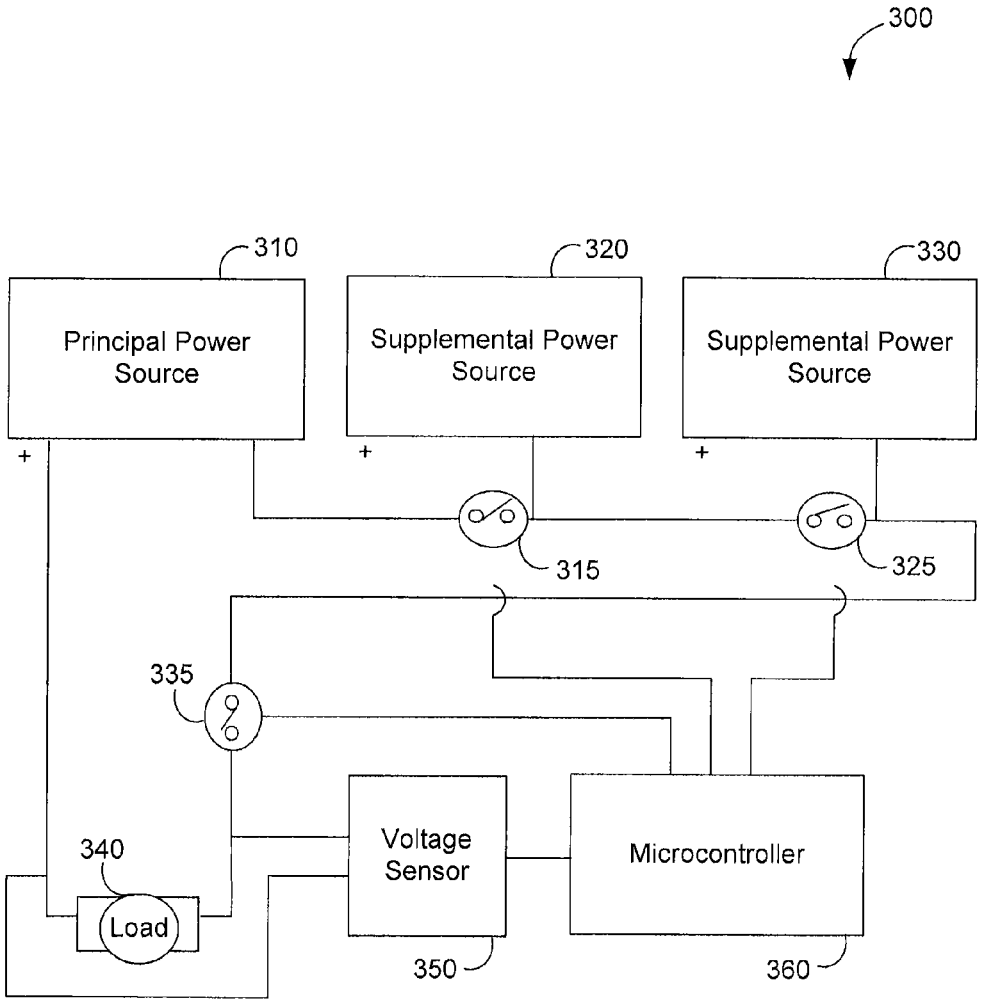
FIG. 2 is a schematic view of an apparatus for providing a substantially constant level of power to a load in accordance with at least one embodiment.

Reference is now made to FIG. 2, which illustrates a schematic view of an apparatus 300 for providing a substantially constant level of power to a load in accordance with at least one embodiment. Apparatus 300 includes a load 340 connected to a principal power source 310 and two supplemental power sources 320, 330. As an example, the connections between the load 340 and the power source may include a first relay 315, a second relay 325, and a third relay 335, such that the apparatus 300 is configured to selectively engage supplemental power source 320 and supplemental power source 330 in series with the principal power source 310 to provide power to load 340. In the exemplary arrangement, if the first relay 315, second relay 325, and the third relay 335 are each closed, only the principal power source 310 will be connected to the load 340 (as supplemental power source 320 and supplemental power source 330 will be effectively bypassed). Alternately, if only the second relay 325 and third relay 335 are closed, then both the principal power source 310 and supplemental power source 320 will be connected to the load 340. The wiring arrangement shown in FIG. 2 is exemplary, and other wiring arrangements could be used to effect the same selective engagement and disengagement of the power sources with respect to the load.

The operation of the first relay 315, second relay 325, and third relay 335 is controller by microcontroller 360. That is, microcontroller 360 is operatively coupled to these relays, and is capable of selectively opening and closing each relay individually, effectively engaging (or connecting) and disengaging (disconnecting) the power sources 310, 320, 330 from the load 340. The relays 315, 325, and 335 may be electromechanical relays, solid state relays (SSRs) or other electronic switching devices controllable by a microcontroller.

Microcontroller 360 is also connected to voltmeter 350, which in turn is connected to the load/power source circuit in order to monitor and measure the operating voltage at the load 340 at any given time. That is, voltmeter 350 provides microcontroller 360 with a real-time (or near-real time) measurement of the voltage being effectively applied to the load 340 by whatever arrangement of power sources is operatively connected to the load at any given time. Voltmeter 350 can be any sensor or device for determining the voltage across the load; in some embodiments (not shown) microcontroller 360 is also capable of performing the voltage measurement, and separate voltmeter 350 may be omitted.

Apparatus 300 may be configured to provide a substantially constant level of power to a load by using a principal power source and supplemental power sources each having rated voltage within a specific range in relation to the predetermined threshold value to minimize fluctuations and large variations in the operating voltage. For example, the principal power source 310 may be rated to provide a principal voltage between 0% and 30% greater than the predetermined threshold voltage level, preferably 10-30% and more preferably 15-25%. Each of the supplemental power sources 320, 330 may be rated to provide a supplemental voltage between 5% and 25% of the predetermined threshold voltage level, preferably 10-25% and more preferably 10-20%. In such a configuration the operating voltage provides a substantially constant level of power ranging between the predetermined threshold voltage level and up to 30% greater than the predetermined threshold voltage level. When the apparatus 300 detects that the operating voltage is lower than a predetermined threshold voltage level and connects a supplemental power source 320, 330 then the operating voltage can increase by between 5% and 25% of the predetermined threshold voltage level.

As another example, the principal voltage may be between 5% and 8% greater than the predetermined threshold voltage level and the supplemental voltage may be between 12% and 15% of the predetermined threshold voltage level. As a further example, the principal voltage may be between 0 and 3 volts greater than the predetermined threshold voltage level, preferably between 1 and 3 volts and more preferably between 1 and 2 volts, and the supplemental voltage may be between 0 and 3 volts, preferably between 1 and 3 volts and more preferably between 1 and 2 volts. As an even further example, the primary voltage may be 9.6 volts, the supplementary voltage may be 1.2 volts and the predetermined threshold voltage may be 9.2 volts, as illustrated in FIG. 1E.

Figure 3:
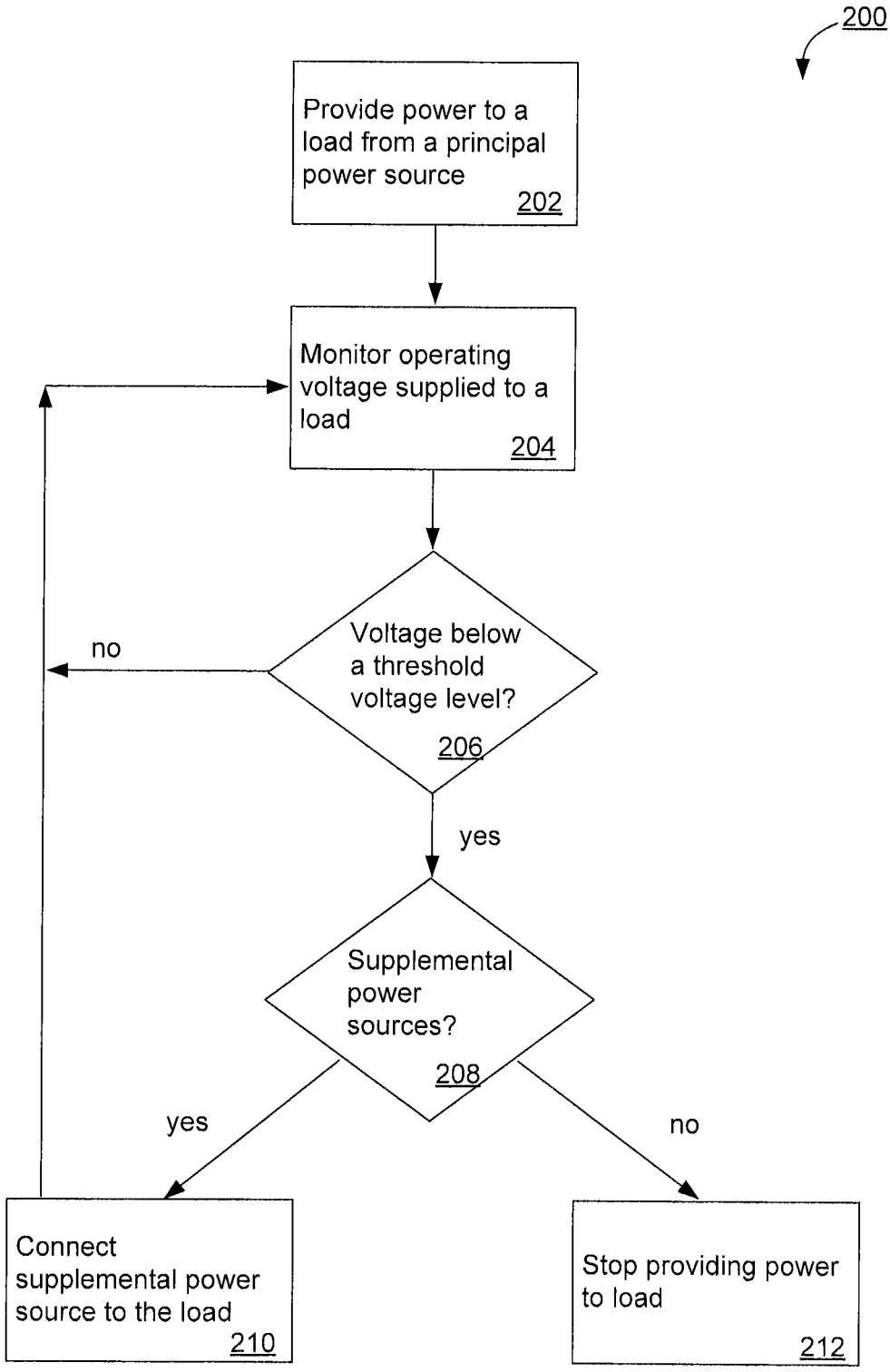
FIG. 3 is a flowchart diagram of a method for providing a substantially constant level of power to a load in accordance with at least one embodiment; and, FIG. 4 is a schematic view of an exemplary vacuum cleaner with a motor that can be powered by the apparatus of FIG. 2 to provide a substantially constant level of power in accordance with at least one embodiment.

Reference is now made to FIG. 3, which illustrates a flowchart diagram of a method 200 of providing a substantially constant level of power to a load in accordance with at least one embodiment.

At step 202, an apparatus 300 provides power to a load from a principal power source. For example, the load could be a motor, and the principal power source could be a secondary cell with a principal rated voltage. The principal power source may have the same rated voltage as the secondary power source(s), or may have a higher power source. Further, there may be one or more principal power sources depending on the load.

At step 204, the apparatus 300 monitors the operating voltage supplied to the load to detect if the operating voltage is below a predetermined threshold voltage level. Initially, only the principal power source is supplying voltage to the load. As supplemental power sources are connected to the load, the operating voltage is the total voltage supplied by the principal power source and the connected supplemental power sources. The apparatus 300 measures, e.g., the actual operating voltage being provided to the load by the principal power source and compares the measured operating voltage to the predetermined threshold voltage level. The operating voltage can be monitored continually or periodically (e.g. the operating voltage may only be re-measured once a predetermined amount of time has elapsed since the operating voltage was last evaluated against the predetermined threshold voltage level). The measurement and comparison may be made by a microcontroller or other suitable means. The microcontroller may be programmed with the predetermined threshold voltage value. The threshold voltage value may be configurable and may change values depending on how many and what type of power sources are connected to the load.

At step 206, the apparatus 300 determines whether the measured operating voltage is below the threshold voltage value. The determination may be made by a microcontroller or other suitable means. If the measured operating voltage is determined to be greater than the predetermined threshold voltage level, then the method returns to step 204 and the apparatus 300 continues to monitor the operating voltage supplied to the load.

If the operating voltage is determined to be lower than the predetermined threshold voltage level, at step 208 the apparatus 300 determines whether there are supplemental power sources available to connect to the load in order to increase the operating power supplied to the load. The determination may be made by a microcontroller or other suitable means.

If there are available supplemental power sources, then at step 210, the apparatus 300 connects a supplemental power source to the load to increase the operating voltage supplied to the load. This connection may comprise engaging (or disengaging) a relay electrically connected to the supplemental power source and the load. Each supplemental power source is connected in series with the principal power source (and any other previously connected supplement power sources) with respect to the load, such that the operating voltage is equal to the sum of the voltages being provided by the principal power source and the supplemental power source(s). There may be n supplemental power sources, where n is a positive integer. At step 210 the apparatus 300 may connect multiple supplemental power sources to the load, where k is the total number of supplemental power sources providing power to the load at a given time and is a positive integer that is less than or equal to n. In accordance with some embodiments, each supplement power source may have a particular rated voltage.

The same number of supplement power sources may be connected at each iteration of step 210, or the number may vary. For example, at each iteration of step 210 one supplemental power source may be connected to the load. As another example, there may be 4 supplemental power sources available to connect to the load (n=4). For the first iteration of step 210, the apparatus 300 connects two supplemental power sources to the load, and for subsequent iterations of step 210, the apparatus 300 connects one supplemental power source to the load each time.

After connecting the supplemental source(s) to the load, the method returns to step 204 and the apparatus 300 continues to monitor the operating voltage supplied to the load.

If there are no supplemental power sources available to connect to the load (all supplemental power sources have already been connected), then at step 210 the apparatus 300 is preferably operable to stop providing power to the load by disengaging the power sources to stop operation of the load and system. The apparatus 300 may stop operation of the load since the operating voltage cannot be maintained at or above the predetermined threshold voltage level.

The method 200 and apparatus 300 for providing a substantially constant power to a load of the instant application may be utilized with any mechanical or electrical system that is powered (at least partially) by battery. For example, embodiments could be used to provide a substantially constant level of power to a motor of a surface cleaning apparatus such as a vacuum cleaner, including any type of vacuum cleaner (e.g. upright, canister, back-pack and central vacuum systems) and a carpet extractor, using any filtration means known in the art. In such a case, the power control apparatus 300 may also be capable of charging the batteries.

Figure 4:
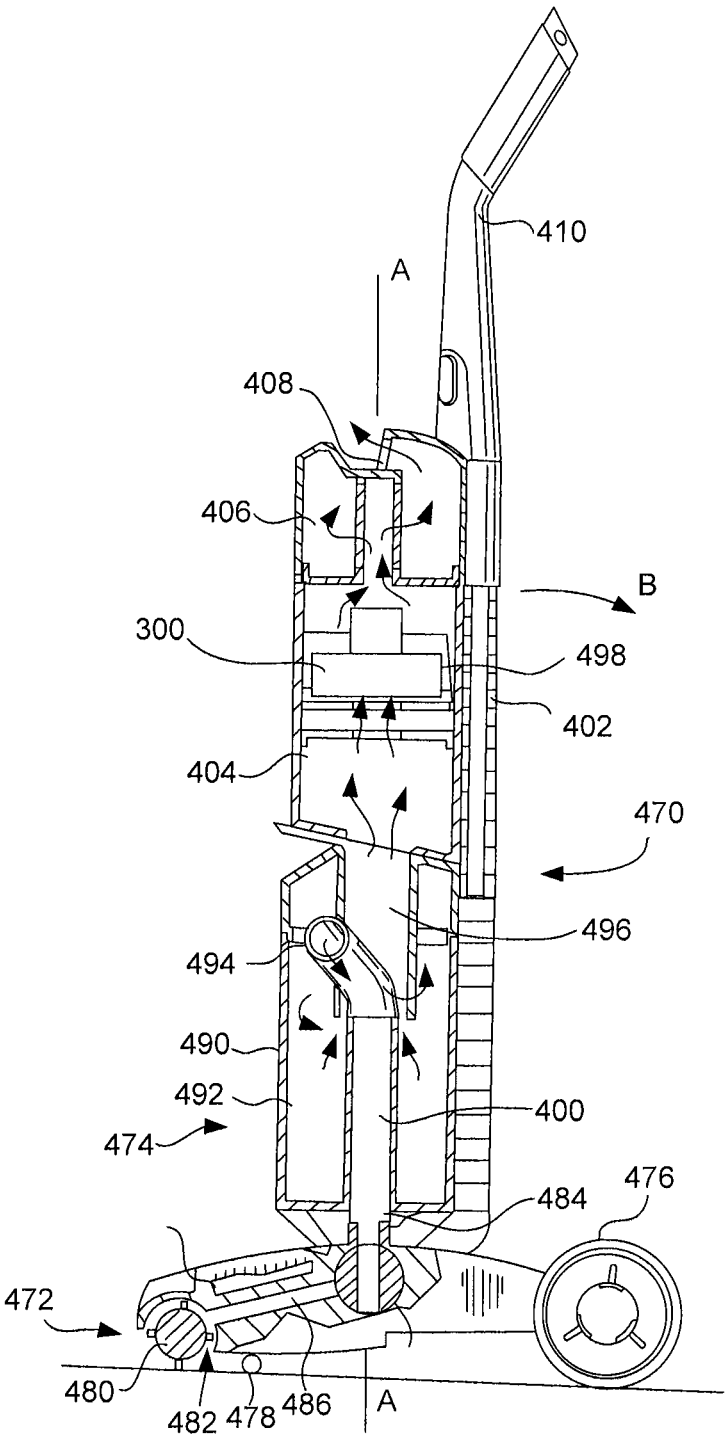

Referring now to FIG. 4, which illustrates a schematic view of an exemplary vacuum cleaner with a motor that can be powered by the apparatus 300 of FIG. 2 to provide a substantially constant level of power in accordance with at least one embodiment. As shown in FIG. 4, an upright vacuum cleaner 470 has vacuum cleaner head 472 and main casing 474. Cleaning head 472 has rear wheels 476 and front wheels 478 to enable movement of cleaning head 472 across a surface. Cleaning head 472 is provided with a rotatably mounted brush 480 that is positioned above dirty air inlet 482. Cleaning head 472 has an air outlet 484 positioned at the end of airflow path 486.

Main casing 474 contains the filtration means that may comprise a cyclone housing 490 defining cyclone chamber 492. Cyclone chamber 492 is provided with an air inlet 494 that is in airflow communication with air outlet 484 by means of airflow path 400. Vacuum cleaner 470 may also be adapted for above floor cleaning such as by means of a hose 402 that is releasably connectable to main casing 474.

Suction motor 498 is positioned above and downstream from air outlet 496. Suction motor 498 may be the load 340 of FIG. 2. That is, suction motor 498 may be a component of (or interact with) the apparatus 300 of FIG. 2 so that the suction motor 498 is provided with a substantially constant level of power in accordance with at least one embodiment. Outlet 408 from vacuum cleaner 470 is provided downstream from suction motor 498. Additional filtration means may be provided, if desired, in one or both of chambers 404 and 406. Handle 410 is provided so as to enable the vacuum cleaner to be pushed by a user.

Methods 200 and apparatus 300 in accordance with embodiments described herein may be utilized with any load powered primarily or complementarily by batteries or cells. For example, the method 200 and apparatus 300 could be used with cordless power tools, portable electronic devices, or electric vehicles with electric or hybrid (e.g. gasoline-electric) power trains.

The batteries or cells referred to herein in the singular (e.g. the principal power source and supplemental power sources) could themselves be comprised of a plurality of individual electro-chemical cells arranged in parallel, so as to increase the discharge current capability of the complete battery.

The functionality of components of the apparatus 300 described herein need not be provided by a single physical component, but may be provided by multiple components. For example, the functionality of a microcontroller may be provided by a single component or multiple electronic components. Similarly, the functionality of a relay may be provided by a single component or multiple electronic components.

The apparatus 300 described herein may comprise additional components (e.g., means for charging secondary cells) that have not been explicitly described or illustrated in the drawings for ease of exposition. Such components may not be required for the understanding of the embodiments described herein, but may be employed in a physical implementation thereof.

The embodiments described herein have been shown and described by way of a number of examples. It will be apparent to those skilled in the art that changes and modifications to the described embodiments may be made without departing from the substance and scope of the described embodiments.

The invention claimed is:

1. An appliance comprising:

a) an onboard principal power source, the appliance being configured to initially operate using the principal power source;

b) at least one supplemental onboard power sources; and, c) a microcontroller configured to monitor an operating voltage being provided to the appliance, and further configured to provide additional power from one or more of the supplemental onboard power sources when the operating voltage is determined to be below a predetermined threshold voltage level.

2. The appliance of claim 1, wherein the appliance comprises n supplemental power sources, where n is a positive integer and the microcontroller is configured to provide power from k of n supplemental power sources, where k is a positive integer less than or equal to n, when the operating voltage is determined to be below the predetermined threshold voltage level.

3. The appliance of claim 1, wherein the primary power source and the n supplemental power sources are connected in series with respect to the appliance.

4. The appliance of claim 1, wherein the principal power source is rated to provide a principal voltage and each of the n supplemental power sources are rated to provide a supplemental voltage, and wherein the principal voltage is between 0% and 30% greater than the predetermined threshold voltage level and wherein the supplemental voltage is between 5% and 25% of the predetermined threshold voltage level.

5. The appliance of claim 4, wherein the principal voltage is between 5% and 8% greater than the predetermined threshold voltage level and the supplemental voltage is between 12% and 15% of the predetermined threshold voltage level.

6. The appliance of claim 1, wherein the principal power source is rated to provide a principal voltage and each of the n supplemental power sources are rated to provide a supplemental voltage, and wherein the principal voltage is between 0 and 3 volts greater than the predetermined threshold voltage level and wherein the supplemental voltage is between 0 and 3 volts.

7. The appliance of claim 6, wherein the primary voltage is 9.6 volts and the supplementary voltage is 1.2 volts.

8. The appliance of claim 1, wherein n is equal to two.

9. The appliance of claim 1, further comprising a voltmeter operatively coupled to the appliance and the microcontroller for measuring the operating voltage.

10. The appliance of claim 1, wherein the principal power source comprises one or more batteries and the supplemental power source comprises one or more batteries.

11. The appliance of claim 10, wherein the supplemental power source comprises a plurality of batteries.

12. The appliance of claim 11, wherein the principal power source comprises a plurality of batteries.

13. A method for providing a substantially constant level of power to an appliance comprising:

a) providing initial power to the appliance from a principal power source connected to the appliance;

b) monitoring an operating voltage supplied to the appliance to detect if the operating voltage is below a predetermined threshold voltage level; and c) upon detecting that the operating voltage is below the predetermined threshold voltage level, providing additional power to the appliance from at least one supplemental power source connected to the appliance.

14. The method of claim 13, wherein step (c) comprises providing power from k of n supplemental power sources connected to the appliance, where k and n are positive integers, and k is less than or equal to n.

15. A method for providing a substantially constant level of power to an appliance comprising:

providing power to the appliance from a principal power source connected to the appliance;

monitoring an operating voltage supplied to the appliance to detect if the operating voltage is below a predetermined threshold voltage level;

upon detecting that the operating voltage is below the predetermined threshold voltage level, providing power to the appliance from at least one supplemental power source connected to the appliance; and upon detecting that the operating voltage is below the predetermined threshold voltage level and where k is equal to n, disengaging the principal and supplemental power sources from the appliance.

16. The method of claim 13, wherein power is provided from each of the k supplemental power sources to the appliance in sequence.

17. The method of claim 13, wherein the principal power source is rated to provide a principal voltage and each of the n supplemental power sources are rated to provide a supplemental voltage, and wherein the principal voltage is between 0% and 30% greater than the predetermined threshold voltage level and wherein the supplemental voltage is between 5% and 25% of the predetermined threshold voltage level.

18. The method of claim 17, wherein the principal voltage is between 5% and 8% greater than the predetermined threshold voltage level and the supplemental voltage is between 12% and 15% of the predetermined threshold voltage level.

19. The method of claim 13, wherein the principal power source is rated to provide a principal voltage and each of the n supplemental power sources are rated to provide a supplemental voltage, and wherein the principal voltage is between 0 and 3 volts greater than the predetermined threshold voltage level and wherein the supplemental voltage is between 0 and 3 volts.

20. The method of claim 19, wherein the primary voltage is 9.6 volts and the supplementary voltage is 1.2 volts.

21. The method of claim 13, wherein n is equal to two.

* * * * *